US009456704B2

(12) United States Patent
Bhargava et al.

(10) Patent No.: US 9,456,704 B2
(45) Date of Patent: Oct. 4, 2016

(54) HIGH EFFICACY LED LIGHT ASSEMBLY FOR A MERCHANDISER

(75) Inventors: Anshuman Bhargava, St. Louis, MO (US); Sesha Madireddi, St. Charles, MO (US); Craig S. Reichert, St. Charles, MO (US)

(73) Assignee: Hussmann Corporation, Bridgeton, MO (US)

( * ) Notice: Subject to any disclaimer, the term of this patent is extended or adjusted under 35 U.S.C. 154(b) by 1857 days.

(21) Appl. No.: 12/709,201

(22) Filed: Feb. 19, 2010

(65) Prior Publication Data

US 2010/0214769 A1 Aug. 26, 2010

Related U.S. Application Data

(60) Provisional application No. 61/154,243, filed on Feb. 20, 2009.

(51) Int. Cl.

| | |
|---|---|
| ***F21W 131/405*** | (2006.01) |
| ***A47F 3/00*** | (2006.01) |
| ***F21V 3/04*** | (2006.01) |
| ***F21V 7/00*** | (2006.01) |
| ***F21V 13/04*** | (2006.01) |
| *F21W 131/305* | (2006.01) |
| *F21Y 101/02* | (2006.01) |
| *F21Y 103/00* | (2016.01) |
| *F21Y 113/00* | (2016.01) |

(52) U.S. Cl.

CPC ..... *A47F 3/001* (2013.01); *F21S 4/28* (2016.01); *F21V 3/04* (2013.01); *F21V 7/0025* (2013.01); *F21V 13/04* (2013.01); *F21W 2131/305* (2013.01); *F21W 2131/405* (2013.01); *F21Y 2101/02* (2013.01); *F21Y 2103/003* (2013.01); *F21Y 2113/00* (2013.01)

(58) Field of Classification Search

CPC ..... F21W 2131/305; F21W 2131/405
USPC ..... 362/92, 125, 94, 126, 218; 312/116, 312/230; 62/82
See application file for complete search history.

(56) References Cited

U.S. PATENT DOCUMENTS

| | | | | |
|---|---|---|---|---|
| 3,609,345 | A | 9/1971 | Perkiss | |
| 3,703,636 | A | 11/1972 | Schmitt | |
| 4,390,930 | A * | 6/1983 | Herst et al. | 362/224 |
| 5,324,573 | A | 6/1994 | Evans | |

(Continued)

FOREIGN PATENT DOCUMENTS

| | | |
|---|---|---|
| CN | 101078480 | 11/2007 |
| DE | 102007053545 | 4/2009 |

(Continued)

*Primary Examiner* — Nimeshkumar Patel
*Assistant Examiner* — Christopher Raabe
(74) *Attorney, Agent, or Firm* — Michael Best & Friedrich LLP

(57) ABSTRACT

A merchandiser including a case and a light assembly coupled to the case. The case defines a product display area and at least one shelf for supporting and displaying food product within the product display area. The light assembly is coupled to the case and is positioned to illuminate the food product. The light assembly includes a housing, at least one LED coupled to the housing, a lens cover defining a sidewall portion of the light assembly, and a specular member coupled to the sidewall portion and spaced apart from the LED to reflect a portion of light from the LED toward the product display area.

32 Claims, 6 Drawing Sheets

(56) References Cited

U.S. PATENT DOCUMENTS

| | | | | |
|---|---|---|---|---|
| 6,435,702 | B1 | 8/2002 | Aikawa et al. | |
| 6,472,458 | B2 | 10/2002 | Yoshimoto et al. | |
| 6,976,695 | B1 * | 12/2005 | Smith, III | 280/507 |
| 7,156,544 | B2 * | 1/2007 | Ishida | 362/538 |
| 7,281,816 | B2 * | 10/2007 | Suzuki | 362/231 |
| 7,513,637 | B2 * | 4/2009 | Kelly et al. | 362/126 |
| 7,824,056 | B2 * | 11/2010 | Madireddi et al. | 362/125 |
| 7,954,979 | B2 | 6/2011 | Sommers et al. | |
| 2004/0194388 | A1 | 10/2004 | Roche et al. | |
| 2004/0218388 | A1 | 11/2004 | Suzuki | |
| 2005/0202178 | A1 | 9/2005 | Roche et al. | |
| 2006/0010572 | A1 | 1/2006 | Douglas | |
| 2006/0127586 | A1 | 6/2006 | Roche et al. | |
| 2006/0238870 | A1 | 10/2006 | Sneek | |
| 2006/0268555 | A1 * | 11/2006 | Kelly | 362/341 |
| 2007/0003700 | A1 | 1/2007 | Roche et al. | |
| 2007/0077399 | A1 | 4/2007 | Borowiec et al. | |
| 2007/0171626 | A1 * | 7/2007 | Chang | 362/97 |
| 2007/0195535 | A1 * | 8/2007 | Artwohl et al. | 362/341 |
| 2008/0007945 | A1 * | 1/2008 | Kelly et al. | 362/218 |
| 2008/0098761 | A1 | 5/2008 | Zangari et al. | |
| 2008/0158858 | A1 * | 7/2008 | Madireddi et al. | 362/92 |
| 2008/0186695 | A1 * | 8/2008 | Awai et al. | 362/92 |
| 2008/0187728 | A1 | 8/2008 | Borowiec et al. | |
| 2008/0247154 | A1 * | 10/2008 | Lim et al. | 362/92 |
| 2009/0207592 | A1 * | 8/2009 | Otsuki et al. | 362/125 |

FOREIGN PATENT DOCUMENTS

| | | |
|---|---|---|
| EP | 2092860 | 8/2009 |
| JP | 2004228143 | 8/2004 |
| WO | 2006067777 | 6/2006 |
| WO | 2009052172 | 4/2009 |

* cited by examiner

HIGH EFFICACY LED LIGHT ASSEMBLY FOR A MERCHANDISER

RELATED APPLICATIONS

This patent application claims priority to U.S. Provisional Patent Application Ser. No. 61/154,243 filed Feb. 20, 2009, the entire contents of which are hereby incorporated by reference.

BACKGROUND

The present invention relates to a merchandiser that includes a light source. More particularly, the present invention relates to a merchandiser including a light emitting diode (LED) light source to illuminate a product display area.

In conventional practice, commercial businesses such as supermarkets and convenience stores are equipped with refrigerated merchandisers. These merchandisers may be open or provided with doors and are used for presenting perishable food or beverages to customers while maintaining the fresh food or beverages in a refrigerated environment. Typically, the refrigerated merchandisers include a light source that illuminates the product display area for better marketing of the food product and for higher visibility to the customers.

Conventional refrigerated merchandisers typically include a fluorescent light source to illuminate the product display area. Some merchandisers include fluorescent light sources that are coupled to a mullion of the merchandiser to direct light generally toward the food product in the product display area. The effectiveness of fluorescent light sources is dependent on the temperature of the application where the fluorescent light sources are used. In colder temperature conditions, the fluorescent light source has less light output than in application of the fluorescent light source in warmer temperature conditions. As a result, fluorescent light sources that are coupled to the mullions can have substantially reduced effective illumination of food product within the product display area.

The fluorescent light sources used in conventional merchandisers are relatively large, and reduce the amount of space in the merchandiser that can be allocated to displaying food product. The generally close proximity of the relatively large mullion-mounted fluorescent light sources to shelves in the refrigerated merchandiser provides an imbalanced, uneven illumination of the product display area.

Other refrigerated merchandisers include light emitting diode (LED) light sources that are mounted to a mullion of the merchandiser to illuminate the product display area. The close proximity of the existing LED light sources to the shelves causes an uneven, imbalanced distribution of light into the product display area. The existing LED light sources only effectively illuminate a portion of the food product on the shelves, resulting in spotlighting some food product on the shelves and leaving other food product partially or substantially obscured due to the lack of uniform illumination of the entire product display area.

SUMMARY

The invention provides an improved merchandiser configured to illuminate a product display area effectively and efficiently. In one construction, the invention provides an improved light source that enables improved illumination of the product display area and reduces the energy required to condition the products within the merchandiser.

In another construction, the invention provides a merchandiser that includes a case defining a product display area and at least one shelf for supporting and displaying food product within the product display area. The merchandiser also includes a light assembly that is coupled to the case and that is positioned to illuminate the food product. The light assembly includes a housing, at least one LED coupled to the housing, a lens cover defining a sidewall portion of the light assembly, and a specular member coupled to the sidewall portion and spaced apart from the LED to reflect a portion of light from the LED toward the product display area.

In yet another construction, the merchandiser includes a light assembly that has a housing defining a plane extending vertically through the light assembly, at least one LED coupled to the housing, a lens cover defining a sidewall portion of the light assembly, and a specular member coupled to the housing to reflect at least a portion of light from the LED into the product display area. The specular member is disposed at an angle greater than 90 degrees relative to the plane.

In yet another construction, the merchandiser includes a light assembly that has a housing defining a plane extending vertically through the light assembly and perpendicular to a mounting surface to which the light assembly is attached, and at least one LED coupled to the housing. The LED defines an axis along which light is generally directed outward from the housing, and the axis angularly spaced between about 40 degrees and 85 degrees from the plane. The light assembly also includes a lens cover that is coupled to the housing and that has a transparent portion and an obscured portion defining a sidewall portion of the light assembly, a first specular member, and a second specular member. The first specular member is coupled to the housing and is disposed at an angle greater than 90 degrees relative to the plane to reflect a portion of light from the LED toward the product display area. The second specular member is coupled to the sidewall portion and is disposed at an angle between about 60 degrees and 120 degrees relative to the first specular member. The second specular member spaced apart from the LED to reflect light from at least one of the LED and the first specular member into the product display area.

Aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Figure 1:
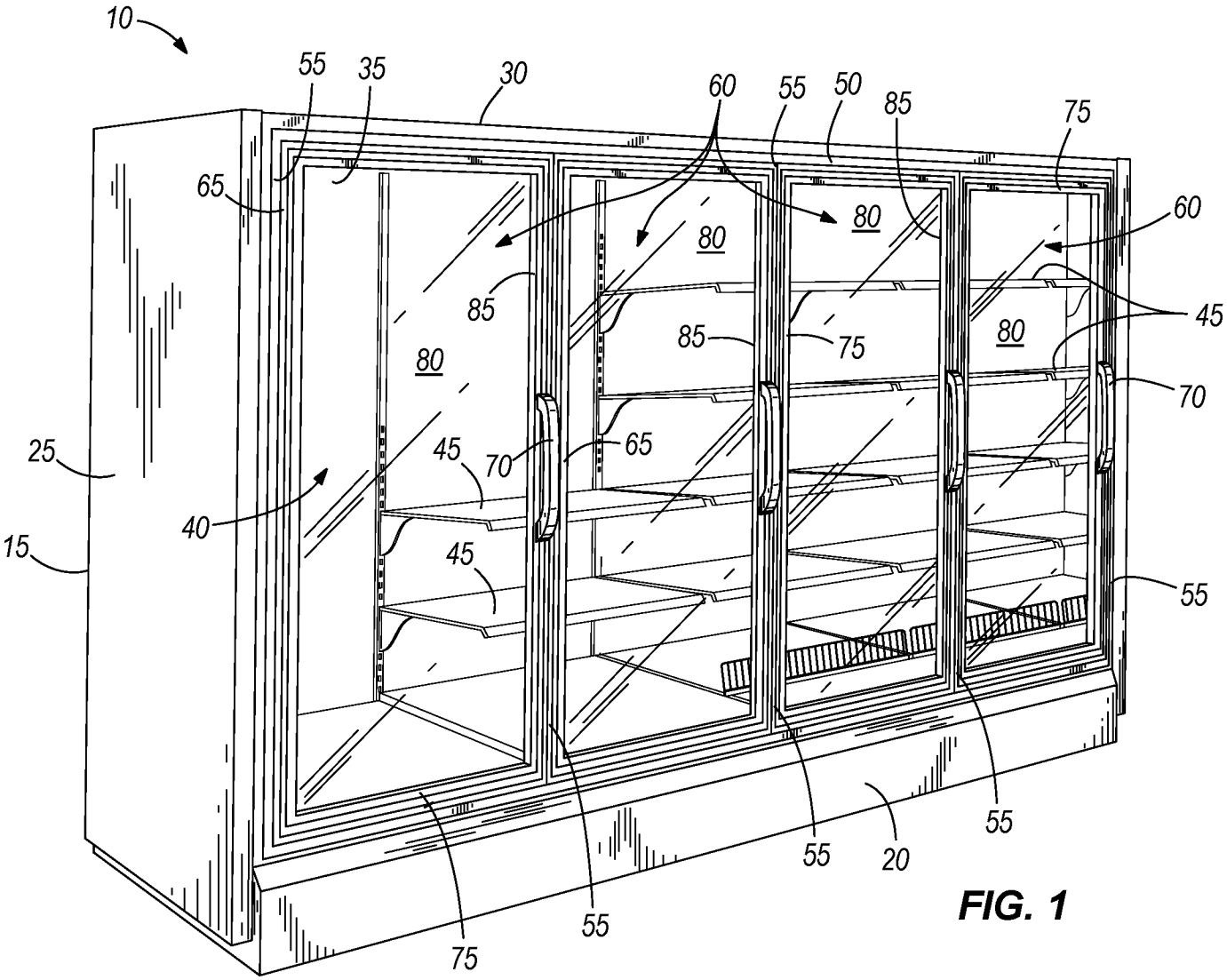
FIG. 1 is a perspective view of an exemplary merchandiser.

FIG. 1 shows a merchandiser 10 for displaying food product (e.g., frozen food, fresh food, beverages, etc.) available to consumers in a retail setting (e.g., a supermarket or grocery store). The merchandiser 10 includes a case 15 that has a base 20, side walls 25, a case top or canopy 30, and a rear wall 35. At least a portion of a refrigeration system (not shown) can be located within the case 15 to refrigerate the food product. In other constructions, a heating system can be located within the case 15 to heat the food product. The area partially enclosed by the base 20, the side walls 25, the case top 30, and the rear wall 35 defines a product display area 40. The food product is supported on shelves 45 within the product display area 40.

The case 15 includes a frame 50 adjacent a front of the merchandiser 10. FIG. 1 shows that the frame 50 includes vertical mullions 55 that define openings 60, and doors 65 positioned over the openings 60. The openings 60 and the doors 65 are configured to allow access to food product stored in the product display area 40. The mullions 55 are spaced horizontally along the case 15 to provide structural support for the case 15. Each mullion 55 is defined by a structural member that can be formed from a non-metallic or metallic material. A handle 70 is positioned along an edge of each door 65 to move the door 65 between an open position and a closed position.

Each door 65 includes a frame 75 that attaches a translucent member 80 to the door 65 to allow viewing of the food product from outside the case 15. The translucent member 80 can be formed from glass, or alternatively, from other materials that are substantially translucent (e.g., acrylic, etc.).

Figure 2:
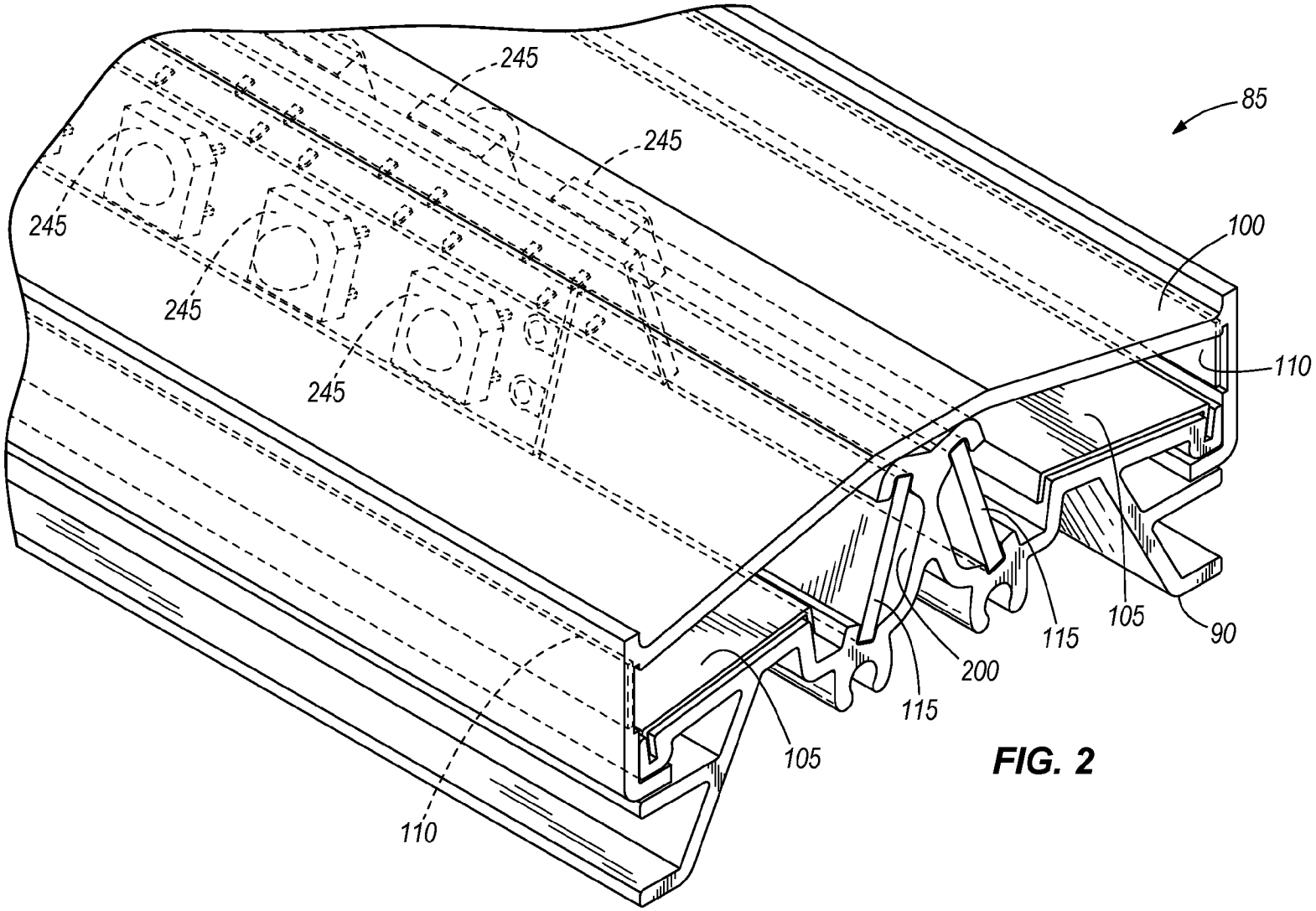
FIG. 2 is a partial perspective view of a light assembly of the merchandiser of FIG. 1, including a housing, a lens cover, and LED light sources having LEDs.
Figure 3:
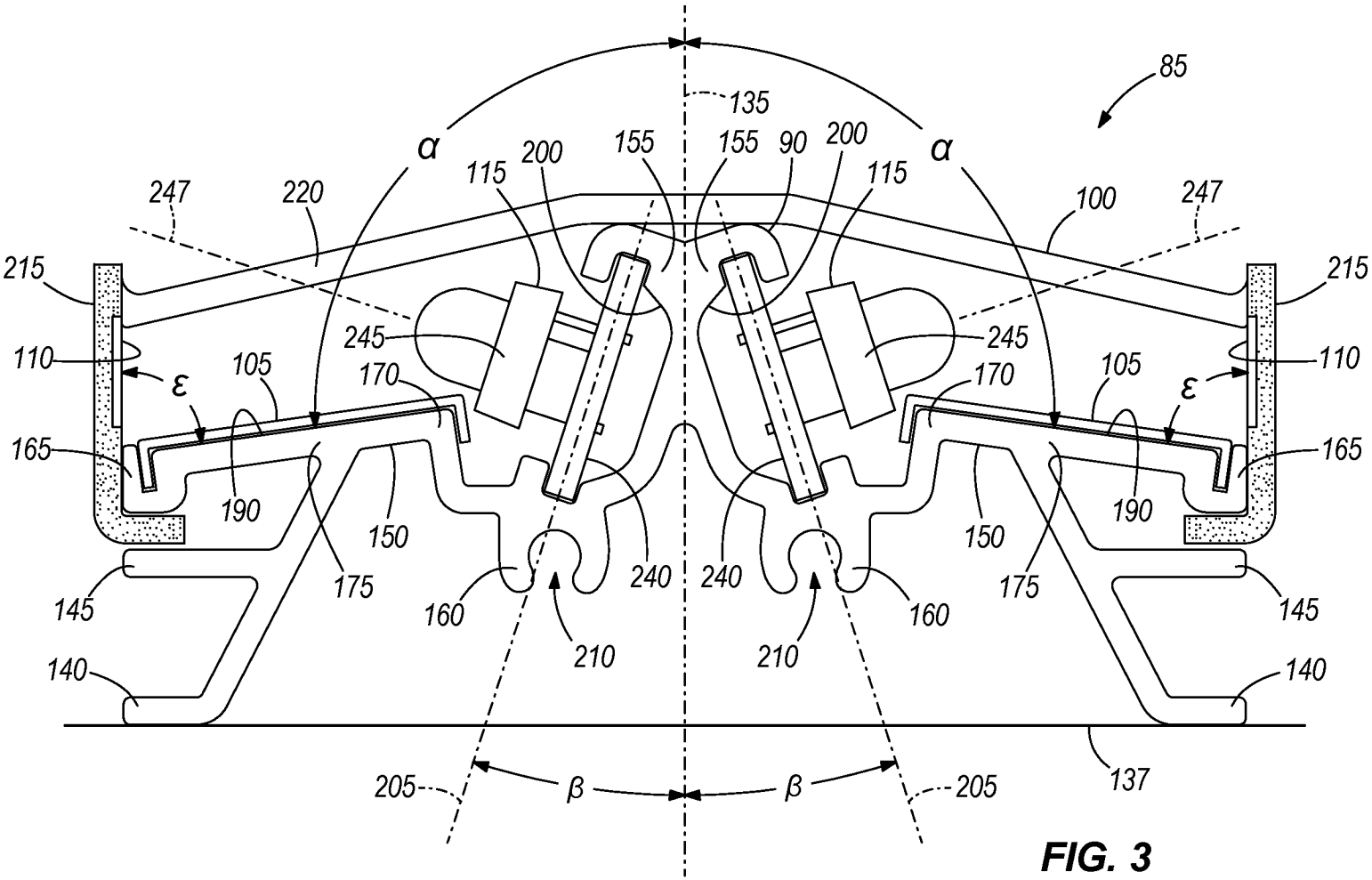
FIG. 3 is an end view of the light assembly of FIG. 2.

FIGS. 2 and 3 show a light assembly 85 that can be attached to each mullion 55 of the case 15 to illuminate the product display area 40. The light assembly 85 includes a housing or shell 90, a translucent lens or lens cover 100, first mirrors or specular members 105, second mirrors or specular members 110, and light emitting diode (LED) light sources 115. The housing 90 can be attached to each mullion 55 using a mullion clip or retainer (not shown), or another similar fastener. In other constructions, the light assembly 85 may be attached to one or more shelves 45 and/or the canopy 30.

Figure 4:
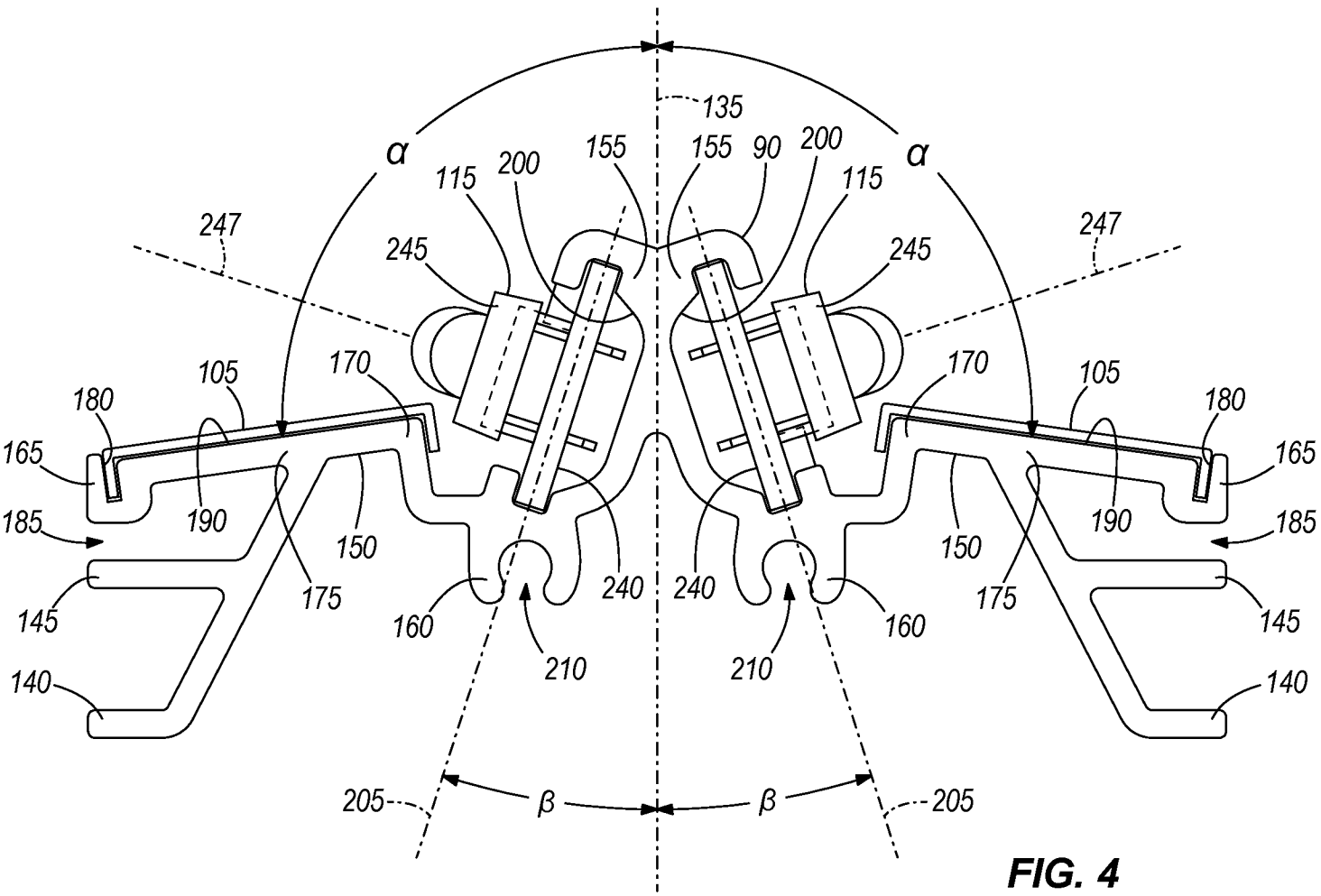
FIG. 4 is an end view of the light assembly of FIG. 2 with the lens cover removed.

FIGS. 3 and 4 show that the housing 90 is defined by an extruded body formed from a high-impact material (e.g., aluminum, composite, etc.) that is resistant to breakage. A first plane 135 passes through a middle of the light assembly 85 and divides the light assembly 85 into a left-hand portion and a right-hand portion. The first plane 135 is perpendicular to a mounting surface 137 to which the light assembly 85 is attached (e.g., a mounting surface of the shelf 45, a mounting surface of the mullion 55). The housing 90 extends along a substantial length of each mullion 55, and is generally symmetrical about the first plane 135. As illustrated in FIGS. 3 and 4, the left-hand portion is substantially a mirror image of the right-hand portion.

The housing 90 includes clip members 140 and attachment portions 145. The clip members 140 extend from sides of the extruded body to couple the housing 90 to the mullion clip. The attachment portions 145 are disposed on each side of and extend from the extruded body.

The housing 90 also includes mirror portions 150, light attachment portions 155, and extruded members 160. Each of the mirror portions 150 is disposed adjacent one light attachment portion 155, and is formed as part of the extruded body. The mirror portion 150 includes a first receiving portion 165, a second receiving portion 170, and a central portion 175 that interconnects the first receiving portion 165 and the second receiving portion 170. Each of the first receiving portions 165 is substantially "U"-shaped, and is disposed on an outer end of the extruded body. The first receiving portion 165 on each end of the extruded body forms a slot 180 that receives a portion of one of the mirrors 105. The first receiving portions 165 further cooperate with the associated attachment portion 145 to define a channel 185 that attaches the lens cover 100 to the housing 90. Each of the second receiving portions 170 is defined on an end of the mirror portion 150 that is opposite the corresponding first receiving portion 165, and are further disposed adjacent the light attachment portions 155.

Each of the central portions 175 extends between the first receiving portion 165 and the second receiving portion 170, and is positioned in close proximity to or adjacent one of the light attachment portions 155. The central portion 175 defines a surface 190 that is disposed at a first angle $\alpha$ relative to the first plane 135. In the illustrated construction, the angle $\alpha$ is approximately ninety-seven degrees. In some constructions, the first angle $\alpha$ may be greater than 90 degrees. In other constructions, the first angle $\alpha$ may be between about 90 degrees and 110 degrees. In still other constructions, the first angle $\alpha$ may be between about 90 degrees and 100 degrees. As shown in FIGS. 3 and 4, the surfaces 190 are substantially planar.

FIG. 4 shows that the light attachment portions 155 are formed as a part of the extruded body, and define stepped recesses 200 that are adjacent the mirror portions 150. A second plane 205 passes through an upper portion of each of the stepped recesses 200. The second plane 205 of each of the light attachment portions 155 is angularly spaced from the associated central portion 175, and defines a second angle $\beta$ relative to the first plane 135. In the illustrated construction, the second angle $\beta$ is about 20 degrees. In some constructions, the second angle $\beta$ may be between about 5 degrees and 90 degrees. In other constructions, the second angle $\beta$ may be between about 5 degrees and 50 degrees. In still other constructions, the second angle $\beta$ may be between about 5 degrees and 35 degrees.

In some constructions, the light assembly 85 may include end caps that are attached to the housing 90 to limit accumulation of debris on the first and second mirrors 105, 110 and the LED light sources 115. Generally, the end caps are removable from the housing 90. The extruded members 160 define channels 210 that are located on the extruded body adjacent and on an opposite side from the light attachment portions 155. The end caps are attached to the housing 90 within the channels 210 to cover the ends of the housing 90.

Figure 5:
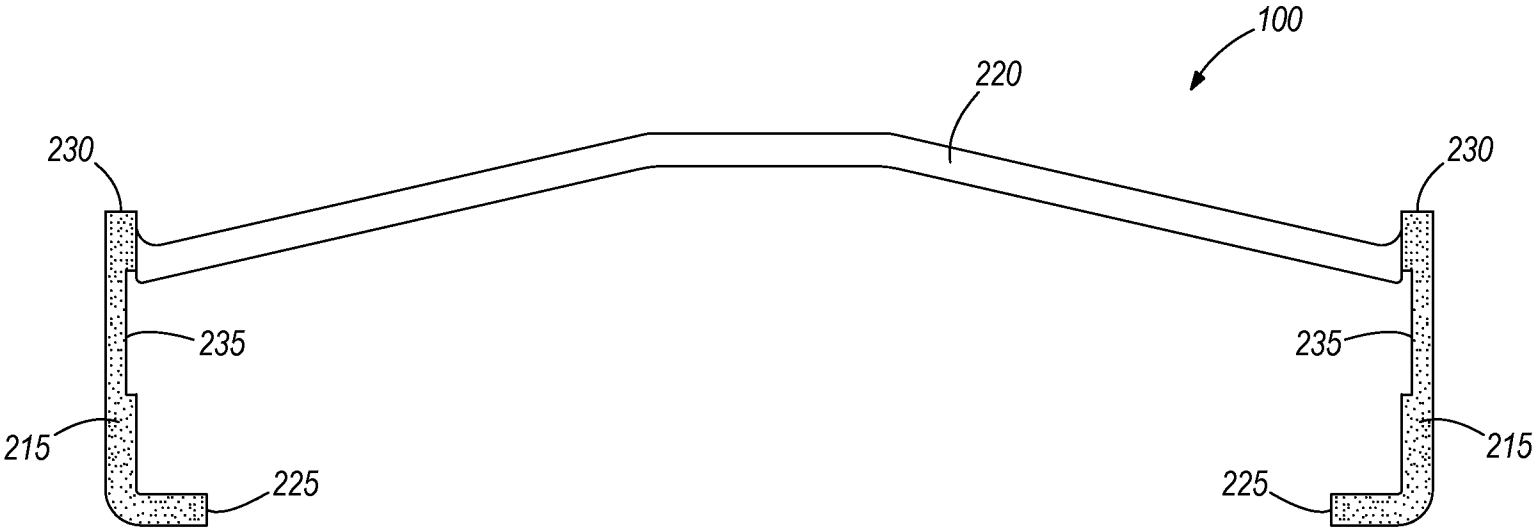
FIG. 5 is an end view of the lens cover of FIG. 2.

FIGS. 3 and 5 show that the lens cover 100 is attached to the housing 90 to protect the LED light sources 115 from debris or incidental contact. The illustrated lens cover 100 includes obscured portions 215 disposed on ends of the lens cover 100 and a substantially clear or transparent portion 220 extending between the obscured portions 215. In the illustrated construction, the obscured portions 215 and the transparent portion 220 are co-extruded with each other (i.e., integrally formed). In some constructions, the obscured portions 215 may be applied or otherwise coupled to the ends of the transparent portion 220 (e.g., opaque material applied to the ends of the transparent portion 220). Other processes also may be used to form the lens cover 100.

Generally, the obscured portions 215 define sidewall portions of the light assembly 85 that at least partially diffuse or block light from the LED light sources through the obscured portions 215, and that obscure visibility of the LED light sources 115 from outside the merchandiser 10. Each of the obscured portions 215 extends farther out from the mullion 55 than the LED light sources 115 to prevent spotlighting some food product on the shelves 45 and leaving other food product partially or substantially obscured due to the lack of uniform illumination of the entire product display area 40. In other words, the obscured portions 215 extend outward from the mullion 55 (i.e., upward in FIGS. 3 and 4) farther than the LED light sources 115 to prevent illuminating the food product with a "Christmas" tree effect.

The illustrated obscured portions 215 are formed from an opaque material, although the obscured portions 215 may be formed from other light obscuring materials. FIG. 5 shows that each of the obscured portions 215 includes a first end 225, a second end 230, and a specular mounting portion 235. The first end 225 is engaged with the housing 90 within the channel 185 to attach the lens cover 100 to the housing 90. The second end 230 is coupled to (e.g., co-extruded with) the transparent portion 220.

The illustrated specular mounting portion 235 is a recess that receives the second mirror 110. Generally, the dimensions of the specular mounting portion 235 substantially correspond to the dimensions of the second mirror 110 (e.g., length, width, thickness). The obscured portion 215 overlaps an end of the transparent portion 220 such that the specular mounting portion 235 is partially covered or enclosed by an end of the transparent portion 220.

The transparent portion 220 is a no-fog or anti-condensation lens that focuses light from the LED light sources 115 on the food product. Generally, the no-fog transparent portion 220 limits formation or accumulation of frost and/or condensate on the lens cover 100. In some constructions, the transparent portion 220 includes a polycarbonate extrusion having no-fog properties. In other constructions, a coating surface that has no-fog properties may be directly applied to the transparent portion 220. In still other constructions, the transparent portion 220 may include one or more thin film laminations.

The first and second mirrors 105, 110 and the LED light sources 115 are generally directed at food product in the product display area 40. The first and second mirrors 105, 110 are formed from a reflective material (e.g., polished aluminum, polished stainless steel, chrome-plated steel, metallized polymer tape, etc.) to reflect light from the adjacent LED light source 115 into the product display area 40 without loss of luminescence. Generally, the reflectance capacity of the first and second mirrors 105, 110 is above about 70 percent reflectance to reflect a substantial amount of light from the LED light source into the product display area 40.

FIGS. 3 and 4 show that each of the first mirrors 105 is attached to the housing 90 within the first and second receiving portions 165, 170 and the central portion 175. In some constructions, the first mirrors 105 can be attached to the first and second receiving portions 165, 170 and the central portion 175 using an adhesive (e.g., epoxy, glue, etc.). Each first mirror 105 extends a substantial length of the light assembly 85, and is substantially flat to conform to the substantially planar surface 190.

As illustrated in FIG. 3, the second mirror 110 is engaged with the specular mounting portion 235 such that the second mirror 110 is oriented at a third angle $\epsilon$ relative to the surface 190. In the illustrated construction, the third angle $\epsilon$ is approximately 83 degrees. In some constructions, the third angle $\epsilon$ is between about 60 degrees and 179 degrees. In other constructions, the third angle $\epsilon$ may be between about 60 degrees and 120 degrees. In still other constructions, the third angle $\epsilon$ may be between about 60 degrees and 100 degrees.

The second mirror 110 is snap-fit or press-fit into engagement with the specular mounting portion 235 to attach the second mirror 110 to the obscured portion 215. The overlapping relationship of the obscured portion 215 and the transparent portion 220 cooperate to partially retain the second mirror 110 in the specular mounting portion 235. In other constructions, the second mirror 10 may be attached to the obscured portion 215 using adhesive (e.g., glue, epoxy, etc.) fasteners, or other attachment means.

Each LED light source 115 is in electrical communication with the case 15 through the mullion 55. FIGS. 2-4 show that the LED light sources 115 are attached to the housing 90 within the stepped recesses 200 of the light attachment portions 155, and include circuit boards 240 that distribute power to and dissipate heat from the LED light sources 115. The circuit boards 240 are made from conventional printed circuit board material without being metal clad. In some constructions, the circuit boards 240 are formed without an aluminum heat sink. Power is supplied to the LED light sources 115 from a power supply (not shown).

The LED light source 115 that is attached to the housing 90 on the left of the first plane 135 (as viewed in FIGS. 3 and 4) is directed in a first direction away from the mullion 55 toward the product display area 40 on the left of the mullion 55. The LED light source 115 that is attached to the housing 90 on the right of the plane 135 (as viewed in FIGS. 3 and 4) is directed in a second direction that is symmetrically opposite the first direction (i.e., away from the mullion 55 toward the product display area 40 on the right of the mullion 55).

With regard to FIGS. 2-4, each of the LED light sources 115 also includes LED packages 245 that are spaced at predetermined distances along the circuit board 240. For example, the LED packages 245 may be defined by an area of about 0.5 inches by 0.5 inches. Each LED package 245 may include any number of LEDs. In some constructions, the LEDs in each LED package 245 may be low current LEDs (e.g., 15 mA).

Referring to FIGS. 3 and 4, an axis 247 passes through a center of each LED package 245. The axis 247 is defined as a zero axis along which light from the LED package 245 is generally distributed outward from the housing 90 toward the product display area 40. As illustrated in FIG. 5, the axis 247 is substantially perpendicular to the second plane 205, and therefore is angularly spaced from the surface 190 by about twenty degrees (i.e., angularly spaced from the surface 190 by the second angle $\beta$). In other constructions, the axis 247 may be angularly spaced from the surface 190 by more or less than twenty degrees.

Generally, a first portion of the light from each LED light source 115 is cast directly toward the product display area 40. A second portion of the light is directed from each LED light source 115 toward the corresponding first mirror 105 where at least a portion of the light is reflected and redirected toward the product display area 40. Some of the second portion of light reflected by the first mirror 105 may be directed toward the second mirror 110. A third portion of light from each LED light source is cast directly toward the corresponding second mirror 110 and/or is indirectly cast toward the second mirror 110 via reflection and redirection of light from the first mirror 105 toward the second mirror 110. The third portion of light is reflected and redirected by the second mirror 110 toward the product display area 40. Thus, the light from the LED light sources 115 is completely, or substantially completely, cast directly or indirectly (i.e., once or twice-reflected) toward the product display area 40 to illuminate the product display area 40. The first and second mirrors 105, 110 and the LED light sources 115 cooperate to define a multi-directional light assembly 85.

Figure 6:
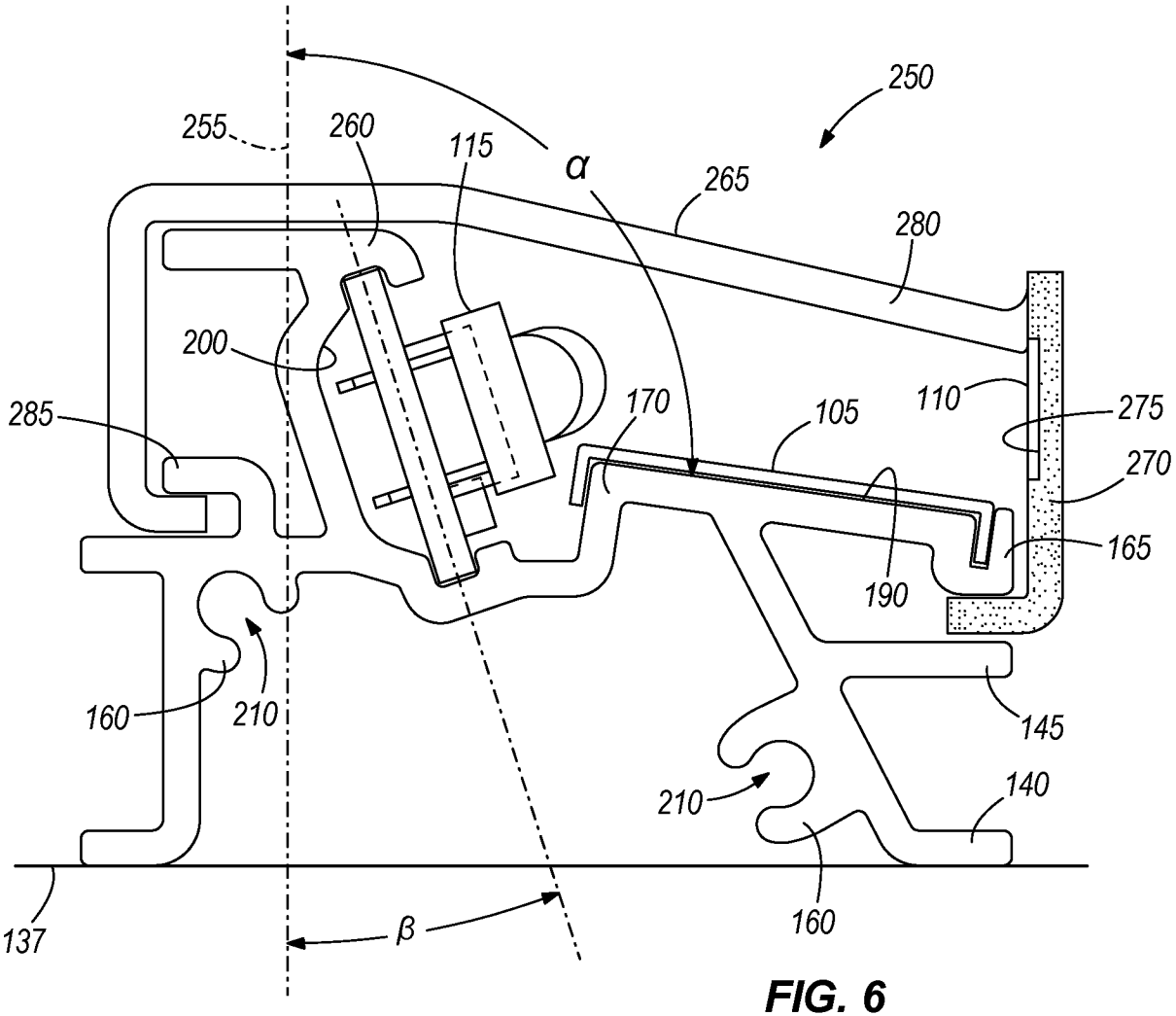
FIG. 6 is an end view of another light assembly of the merchandiser of FIG. 1 including a housing, a lens cover, and a LED light source.

FIG. 6 shows another construction of a light assembly 250 that may be used on the merchandiser 10 adjacent an end of the case 15. Except as described below, the light assembly 250 is similar to the light assembly 85 described with regard to FIGS. 2-5, and common elements are given the same reference numerals. As illustrated in FIG. 6, a plane 255 divides the light assembly 250 into a right-hand portion and a left-hand portion.

The light assembly 250 includes the first mirror 105, the second mirror 110, the LED light source 115, a housing 260, and a translucent lens cover 265 that is attached to the housing 260. The housing 260 is defined by an extruded body that can be attached to the interior side of each end mullion 55 using a mullion clip (not shown). The lens cover 265 is similar to the cover 100, and includes an obscured portion 270 having a specular mounting portion 275, and a transparent portion 280.

The right-hand portion of the light assembly 250 is generally the same as the right-hand portion of the light assembly 85 described with regard to FIG. 3. Specifically, the right-hand portion of the housing 260 is substantially similar to the right-hand portion of the housing 90, except that the extruded members 160 are located in different positions. For example, one extruded member 160 is positioned adjacent and opposite the clip member 145 and the attachment portion 150 on the right-hand portion of the housing 260. The left-hand portion of the housing 260 further defines an attachment portion 285 that attaches the cover 265 to the housing 260. The other extruded member 160 is located adjacent and opposite the attachment portion 285 on the left-hand portion. The extruded members 160 can be located anywhere on the housing 260 as long as end caps of the light assembly 250 can be attached to the ends of the housing 260.

The first mirror 105 is attached to the housing 260 within the first and second receiving portions 165, 170, and is only located on one side of the housing 260 due to the light assembly 250 being located on the end of the case 15. The second mirror 110 is attached to the lens cover 265 within the specular mounting portion 275. The LED light source 115 is attached to the housing 260 within the stepped recess 200 of the light attachment portion 160. Similar to the light assembly 85, light from the LED light source 115 is cast directly toward the product display area 40, or indirectly by reflection and redirection via the first mirror 105 and/or the second mirror 110. The light from the LED light sources 115 is completely, or substantially completely, cast directly or indirectly (i.e., once or twice-reflected) toward the product display area 40 to illuminate the product display area 40 adjacent the end of the case 15.

In operation, the opposed, multi-directional light assembly 85 uniformly illuminates the product display area 40 while being substantially hidden from view. In particular, light from the LED sources 115 is not visible to an individual reaching into the product display area 40 or standing outside the case 15 due to the obscured portions 215. Light directed from the LED light sources 115 is cast directly or indirectly by reflection and redirection of light via one or both of the first mirrors 105 and the second mirrors 110 toward the product display area 40 in multiple directions. The LED light source 115 coupled to the housing 90 within the left-hand stepped recess 200 illuminates the product display area 40 to the left and right of the mullion 55 due to the angular relationships between the LED light source 115, the surface 190 (and therefore the first mirror 105), and the second mirror 110. The light is cast directly into the product display area 40, and is further reflected by the first mirror 105 (i.e., once-reflected) and the second mirror 110 (i.e., once or twice-reflected).

Similarly, light directed from the LED light source 115 coupled to the right-hand stepped recess 190 illuminates the product display area 40 to the left and right of the mullion 55 due to the angular relationships between the LED light source 115, the surface 190 (and therefore the first mirror 105), and the second mirror 110. The light is cast directly into the product display area 40, and is further reflected by the first mirror 105 (i.e., once-reflected) and the second mirror 110 (i.e., once or twice-reflected).

The direct light cast toward the product display area 40 and the reflected light (i.e., once or twice reflected) cast toward the product display area 40 substantially illuminates the food product. The first angle $\alpha$ defined by the surface 190 relative to the first plane 135 and the inclination of the surface 190 relative to the axis 247 (i.e., relative to the angular orientation of the LED packages 245) provides light angles of incidence that broadly or widely reflect and redirect light cast onto the first mirror 105 toward the product display area 40. Furthermore, the third angle $\epsilon$ defined by the second mirror 110 and the surface 190 provide light angles of incidence relative to the first mirror 105 and the LED light source 115 that broadly reflect and redirect light cast upon the second mirror 110 (i.e., light from the first mirror 105 and/or light from the LED light source 115) toward the product display area 40. The orientation of the first mirrors 105 and the second mirrors 110 relative to the LED light sources 115 cooperate to substantially illuminate the product display area 40 by providing the light assemblies 85, 250 with a substantially high efficacy of illuminating the product display area 40. Furthermore, the co-extruded lens covers 100, 265 having cooperating obscured portions 215 and transparent portions 220 substantially eliminate stray light that is visible by an individual outside the case 15 without loss of illumination.

By directing a portion of light directly into the product display area 40 and by reflecting the remaining light from the LED packages 245 via the first and second mirrors 105,110, food product in the refrigerated merchandiser 10 is substantially illuminated. Generally, the second mirrors 110 complement the inclined first mirrors 105 and the LED light sources 115 to increase the illumination effect (e.g., lumens/watt) of the LED light sources 115 on the product display area 40 relative to light assemblies without the first mirrors 105 and/or the second mirrors 110.

The mullion light assemblies 85, 250 can be used together or separately with other light assemblies (not shown) in the merchandiser 10 to illuminate the product display area 40. Use of low current LED packages 215, 220 in each light assembly 85, 250 provides substantial energy savings. Generally, the overall power required to illuminate and to refrigerate the case 15 using the LED light sources 115 is lower than the power required by cases that use fluorescent light sources. The low current LED light assemblies 85, 250 also can be used to replace existing fluorescent of existing merchandisers to provide similar illumination of the product display area 40 via more economical means.

Various features and advantages of the invention are set forth in the following claims.

The invention claimed is:

1. A merchandiser comprising:

a case defining a product display area and at least one shelf for supporting and displaying food product within the product display area; and a light assembly coupled to the case and positioned to illuminate the food product, the light assembly including a housing, at least one LED coupled to the housing, a lens cover defining a sidewall portion of the light assembly, and a specular member coupled to the sidewall portion and spaced apart from the LED to reflect a portion of light from the LED toward the product display area.

2. The merchandiser of claim 1, wherein the lens cover is a frost-inhibiting lens cover including an obscured portion and a transparent portion, and wherein the obscured portion defines the sidewall portion.

3. The merchandiser of claim 2, wherein the obscured portion includes a recess and the specular member is coupled to the obscured portion within the recess.

4. The merchandiser of claim 2, wherein the obscured portion includes light obscuring material and the transparent portion includes transparent material, and wherein the obscured portion and the transparent portion are co-extruded with each other.

5. The merchandiser of claim 1, wherein the LED is positioned to cast a first portion of light directly into the product display area, and to cast a second portion of light directly toward the specular member such that the second portion of light is reflected and redirected by the specular member toward the product display area.

6. The merchandiser of claim 1, wherein the housing defines a plane extending vertically through the light assembly and perpendicular to a mounting surface to which the light assembly is attached, and wherein the specular member is positioned substantially parallel to the plane.

7. A merchandiser comprising:

a case defining a product display area and at least one shelf for supporting and displaying food product within the product display area; and a light assembly coupled to the case and positioned to illuminate the food product, the light assembly including a housing defining a plane extending vertically through the light assembly and perpendicular to a mounting surface to which the light assembly is attached, at least one LED coupled to the housing, and a specular member coupled to the housing to reflect at least a portion of light from the LED into the product display area, the specular member disposed at an angle greater than 90 degrees relative to the plane.

8. The merchandiser of claim 7, wherein the specular member is disposed at an angle greater than 90 degrees and less than or approximately equal to 110 degrees relative to the plane.

9. The merchandiser of claim 8, wherein the specular member is disposed at an angle of approximately 97 degrees relative to the plane.

10. The merchandiser of claim 8, wherein the LED defines an axis along which light is generally directed outward from the housing, and wherein the axis is angularly spaced between about 40 degrees and 85 degrees from the plane.

11. The merchandiser of claim 10, wherein the axis is angularly spaced approximately 70 degrees from the plane.

12. The merchandiser of claim 10, wherein the LED is positioned to cast a first portion of light directly into the product display area, and to cast a second portion of light directly toward the specular member such that the second portion of light is reflected by the specular member toward the product display area.

13. The merchandiser of claim 12, wherein the specular member is a first specular member, and wherein the light assembly is defined by a sidewall portion and further includes a second specular member coupled to the sidewall portion and spaced apart from the LED to reflect at least a portion of light from the LED toward the product display area.

14. The merchandiser of claim 13, wherein the light assembly further includes a lens cover having a transparent portion with transparent material and an obscured portion with light obscuring material, and wherein the obscured portion defines the sidewall portion.

15. The merchandiser of claim 14, wherein the transparent portion and the obscured portion are co-extruded with each other.

16. The merchandiser of claim 13, wherein the second specular member is substantially parallel to the plane.

17. The merchandiser of claim 13, wherein the second specular member is disposed at an angle between about 60 degrees and 120 degrees relative to the first specular member.

18. The merchandiser of claim 17, wherein the second specular member is disposed at an angle between about 60 degrees and 90 degrees relative to the first specular member.

19. The merchandiser of claim 17, wherein the second specular member is disposed at an angle of approximately 83 degrees relative to the first specular member.

20. The merchandiser of claim 17, wherein the second specular member is positioned to further reflect at least a portion of light reflected from the first specular member toward the product display area, and wherein the LED is positioned to cast a third portion of light directly toward the second specular member such that the third portion of light is directly reflected by the second specular member toward the product display area.

21. A merchandiser comprising a case defining a product display area and at least one shelf for supporting and displaying food product within the product display area; and a light assembly coupled to the case and positioned to illuminate the food product, the light assembly including a housing defining a plane extending vertically through the light assembly and perpendicular to a mounting surface to which the light assembly is attached, at least one LED coupled the housing and defining an axis along which light is generally directed outward from the housing, the axis angularly spaced between about 40 degrees and 85 degrees from the plane, a lens cover coupled to the housing and having a transparent portion and an obscured portion defining a sidewall portion of the light assembly, a first specular member coupled to the housing and disposed at an angle greater than 90 degrees relative to the plane to reflect a portion of light from the LED toward the product display area, and a second specular member coupled to the sidewall portion and disposed at an angle between about 60 degrees and 120 degrees relative to the first specular member, the second specular member spaced apart from the LED to reflect light from at least one of the LED and the first specular member into the product display area.

22. The merchandiser of claim 21, wherein the obscured portion includes light obscuring material and the transparent portion includes transparent material, and wherein the obscured portion and the transparent portion are co-extruded with each other.

23. The merchandiser of claim 21, wherein the second specular member is substantially parallel to the plane.

24. The merchandiser of claim 21, wherein the first specular member is disposed at an angle greater than 90 degrees and less than or approximately equal to 110 degrees relative to the plane.

25. The merchandiser of claim 24, wherein the specular member is disposed at an angle of approximately 97 degrees relative to the plane.

26. The merchandiser of claim 21, wherein the axis is angularly spaced approximately 70 degrees from the plane.

27. The merchandiser of claim 21, wherein the second specular member is coupled to the obscured portion within a recess.

28. The merchandiser of claim 21, wherein the second specular member is positioned to reflect at least a portion of light reflected from the first specular member toward the product display area, and wherein the LED is positioned to cast a portion of light directly toward the second specular member such that the portion of light from the LED is directly reflected by the second specular member toward the product display area.

29. The merchandiser of claim 21, wherein the second specular member is disposed at an angle between about 60 degrees and 90 degrees relative to the first specular member.

30. The merchandiser of claim 29, wherein the second specular member is disposed at an angle of approximately 83 degrees relative to the first specular member.

31. The merchandiser of claim 21, wherein the LED is positioned to cast a first portion of light directly into the product display area, to cast a second portion of light directly toward the first specular member such that the second portion of light is reflected by the first specular member toward at least one of the product display area and the second specular member, and to cast a third portion of light directly toward the second specular member such that the third portion of light is reflected by the second specular member toward the product display area.

32. The merchandiser of claim 21, wherein the light assembly is substantially symmetrical about the plane.

* * * * *